United States Patent [19]

Podany

[11] 4,074,245

[45] Feb. 14, 1978

[54] POWER FAILURE ALARM

[76] Inventor: John P. Podany, 8299 Mitchell Road, Eden Prairie, Minn. 55343

[21] Appl. No.: 706,259

[22] Filed: July 19, 1976

[51] Int. Cl.[2] ..... G08B 21/00

[52] U.S. Cl. ..... 340/248 B; 340/253 C; 340/326; 340/371; 340/400

[58] Field of Search ..... 340/248 B, 253 C, 371, 340/373, 375, 376, 400, 327, 326

[56] References Cited

U.S. PATENT DOCUMENTS

| | | | |
|---|---|---|---|
| 1,194,571 | 8/1916 | Swan | 340/376 |
| 2,681,443 | 6/1954 | Caulk, Jr. | 340/253 C |
| 2,820,892 | 1/1958 | Spangler | 340/248 B X |

*Primary Examiner*—John W. Caldwell, Sr.
*Assistant Examiner*—Daniel Myer
*Attorney, Agent, or Firm*—Stuart R. Peterson

[57] ABSTRACT

An alarm device for connection between an electric appliance and a power source to provide an audible and visual signal of a power failure. The device includes a first circuit in series with the appliance and power source containing an electro-magnet holding a spirally wound spring hammer in spaced relation to a gong. Upon occurrence of a power failure, the electromagnet is deactivated, releasing the hammer which strikes the gong. Simultaneously, a second circuit in parallel to the first having a switch spring-biased to an open position in the path of movement of the hammer and connected to a light is closed by the hammer. Upon restoration of power, the light is activated to indicate the occurrence of the power failure. A post connected to the free end of the hammer is used to reset the device by returning the hammer to the influence of the electromagnet, also enabling the spring-biased switch to reopen, upon the restoration of power.

4 Claims, 3 Drawing Figures

POWER FAILURE ALARM

BACKGROUND OF THE INVENTION

This invention relates to a device adapted to be connected to an electrical appliance, such as a clock radio, to visually and audibly give an alarm in the event of a power failure.

Clock radios are commonly used to sound an alarm to awaken a sleeping person at a particular predetermined time. In the event of a power failure unbeknown to the sleeping person, the clock will be turned off during the period of failure and restored after the failure has been corrected. The clock will therefore indicate the incorrect time and the alarm to awaken the sleeping person will be sounded at a time later than desired by an amount equivalent to the period of the failure. This invention provides an alarm device which will provide an audible signal at the time of the power failure to awaken the sleeping person and alert him to the fact of the failure, so the clock can be reset to compensate for the time period of the failure. In the event the audible alarm is not heard, a visual alarm is simultaneously activated to indicate to the sleeping person that a power failure has occurred when he awakens.

SUMMARY OF THE INVENTION

In accordance with the invention a housing is provided which is electrically connected in series between the clock radio and power receptacle. An electromagnet is provided in this circuit within the housing. The electromagnet normally holds a springloaded hammer for striking a gong mounted in the housing. Upon a power failure occurring, the electromagnet is deactivated releasing the hammer to strike the gong. Simultaneously, the hammer closes a switch completing an electrical circuit containing a light. When power is restored, the circuit to the light is actuated to give a visual signal of the power failure. A post connected to the hammer is used to reset the device once power is restored.

BRIEF DESCRIPTION OF THE DRAWING

Further objects and advantages of the invention will become apparent from the following description and claims, and from the accompanying drawing, wherein:

DETAILED DESCRIPTION OF THE PREFERRED EMBODIMENT

Figure 1:
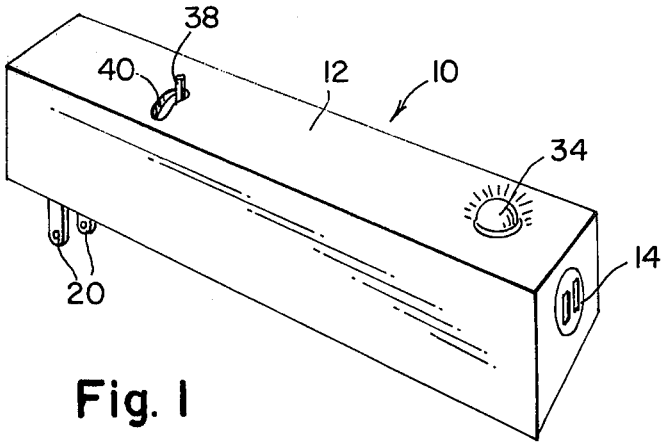
FIG. 1 is a perspective view of the power failure alarm device of the present invention.
Figure 2:
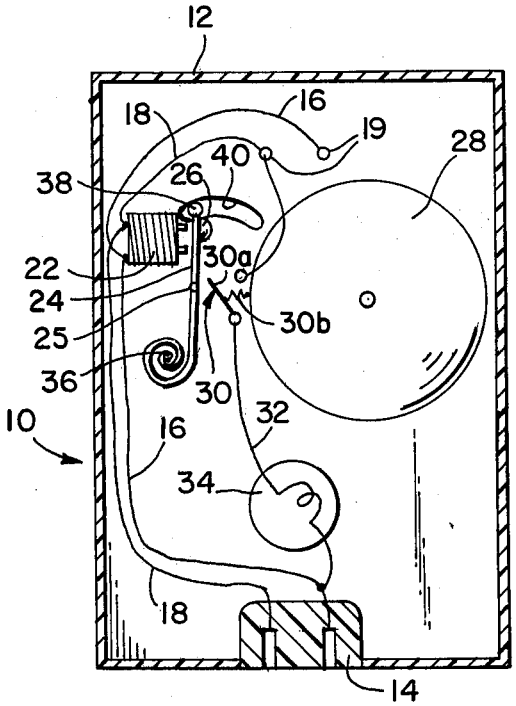
FIG. 2 is a longitudinal cross-sectional view of the device of FIG. 1, certain ones of the components being illustrated schematically.
Figure 3:
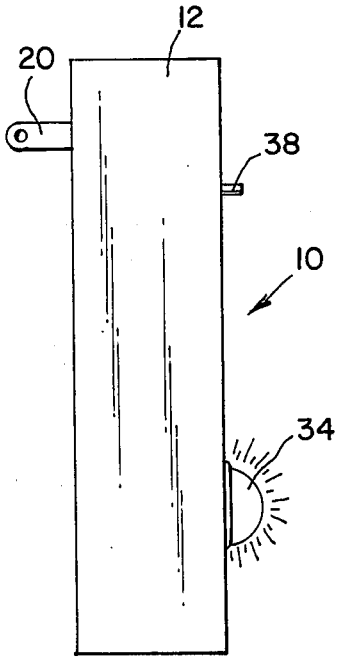
FIG. 3 is a side view in elevation of the device of FIG. 1.

Referring now to the drawing in detail, wherein like numerals indicate like elements throughout the several views, the device 10 of the present invention includes a substantially rectangular housing 12 which is adapted to be connected in electrical series between a clock radio and a power receptacle. In order to provide this connection, housing 12 has an electrical receptacle 14 for receiving the plug of the clock radio connected by wires 16 and 18 to the terminals 19 of an electrical plug 20 adapted to be placed in a power source receptacle.

An electromagnet 22 is connected in parallel or across the circuit between receptacle 14 and terminals

19 by connecting its terminals to wires 16 and 18. Electromagnet 22 normally holds a spirally wound spring hammer 24 having an offset portion 25 and a striker element 26 for striking a bell gong 28 mounted in the housing. Upon a power failure occurring; the electromagnet 22 is deactivated, allowing spring hammer 24 to uncoil causing striker element 26 to hit gong 28 to sound an alarm indicating that a power failure has occurred.

A switch 30, only schematically shown, is connected by a wire 32 in parallel with wires 16 and 18 to a light 34 mounted on the exterior of housing 12. Switch 30 has a spring-loaded lever arm **30*a* (there being a coil spring 30*b*) in the path of movement of the offset portion 25 hammer 24 so that when electromagnet 22 is deactivated, the offset portion 25 hammer 24 will strike the lever arm of switch 30 to simultaneously close switch 30. Upon restoration of power to the circuit, light 34** will be activated to visually signal that a power failure has occurred.

Hammer 24 is connected at one end to a fixed pin 36 and at its other end to a post 38 slideable in a curved slot 40 on housing 12 and accessible from the exterior of housing 12. Thus, upon the restoration of power, post 38 is slid to its initial position to return hammer 24 into the field of electromagnetic 22 to reset device 10. Simultaneously, the spring-loaded lever arm of switch 30 opens by reason of the coil spring **30*b* to completely reset device 10**.

I claim:

1. A power failure alarm device comprising:

a housing, first electric circuit means in said housing for electrically connecting an electrical appliance in series to a power source, an electromagnet connected to said first electric circuit means and energized by said first electric circuit means only when power is supplied to said first electric circuit means from said power source, and an audible alarm in said housing, said audible alarm including a gong mounted in said housing, and a movable striker element normally restrained by said electromagnet in spaced relation to said gong, spring means mounted within said housing for moving said striker element in a direction away from said electromagnet and to strike said gong when said electromagnet is de-energized by an interruption of power supplied to said first electric circuit means from said power source, said gong being spaced from said electromagnet a distance sufficient to assure that said striker element will not be automatically attracted in a reverse direction back toward said electromagnet when said electromagnet is re-energized and a post mechanically connected to said striker element extending exteriorly of said housing in a slot therethrough, a second electric circuit means in said housing in parallel to said first circuit means, said second circuit means including a light and a switch closable by said means for moving said striker element when said striker element is being moved toward said gong, whereby upon a power failure occurring, said striker element is released by said electromagnet so that said spring means causes said striker element to strike said gong and to simultaneously close said switch so that said light is automatically actuated upon the restoration of power to said first electric circuit means from said power source, said striker element being returnable toward said electromagnet only by manually sliding said post in said slot towards said electromagnet, the actuation of said light indicating that power has been restored and that said post can be manually slid toward said electromagnet and that said striker element will then again be restrained by said electromagnet.

2. An alarm device in accordance with claim 1 wherein said switch is spring-biased to an open position when said post is manually slid in said slot towards said electromagnet.

3. An alarm device in accordance with claim 2 wherein said first electric circuit means includes a plug receptacle for receiving the plug of an electric appliance.

4. An alarm device in accordance with claim 3 wherein said first electric circuit means includes a plug on said housing for connecting said circuit means to a source of electrical power.

* * * * *